United States Patent [19]

Artz et al.

[11] Patent Number: 4,510,990

[45] Date of Patent: Apr. 16, 1985

[54] CONTINUOUS CASTING APPARATUS WITH SHRINKAGE COMPENSATION

[75] Inventors: Gerd Artz, Ratingen; Dieter Figge, Essen; Clemens Philipp, Meerbusch, all of Fed. Rep. of Germany

[73] Assignee: Fried. Krupp Gesellschaft mit beschränkter Haftung, Essen, Fed. Rep. of Germany

[21] Appl. No.: 527,949

[22] Filed: Aug. 30, 1983

[30] Foreign Application Priority Data

Aug. 30, 1982 [DE] Fed. Rep. of Germany ..... 3232147

[51] Int. Cl.[3] ..... B22D 11/10

[52] U.S. Cl. ..... 164/431; 164/436

[58] Field of Search ..... 164/431, 430, 481, 491, 164/436

[56] References Cited

U.S. PATENT DOCUMENTS

| | | | |
|---|---|---|---|
| 3,452,809 | 7/1969 | Dumont-Fillon | 164/481 |
| 3,978,909 | 9/1976 | Schäffmann | 164/436 |
| 4,061,177 | 12/1977 | Sivilotti | 164/436 |

*Primary Examiner*—Nicholas P. Godici
*Assistant Examiner*—G. Reid
*Attorney, Agent, or Firm*—Spencer & Frank

[57] ABSTRACT

A continuous casting apparatus for a metal casting arranged to compensate for shrinkage of the casting in a cross sectional plane of the casting normal to the casting direction. The apparatus includes a pair of endless casting belts each spaced from and facing the other to form respective mold walls and arranged for movement in the casting direction. A pair of endless articulated mold walls, each spaced from and facing the other, is disposed between the casting belts and arranged to move with the casting belts in the casting direction. The spacing between the articulated mold walls and between the casting belts is greater upstream than downstream relative to the casting direction. Each articulated mold wall includes a plurality of dam blocks. Each block has an inner face disposed at an angle relative to the casting belts and defining a surface of the casting transverse to the casting belts, and an outer face disposed at an angle relative to the casting belts and facing a direction opposite to that of the inner face. At least one of the faces of each dam block is adjustable in height between the casting belts. Guide means are provided for adjusting the height of the at least one face of each dam block.

19 Claims, 12 Drawing Figures

CONTINUOUS CASTING APPARATUS WITH SHRINKAGE COMPENSATION

BACKGROUND OF THE INVENTION

The present invention relates to a continuous casting apparatus, particularly for a continuous steel casting, which is arranged to compensate for shrinkage of the casting in a cross-sectional plane normal to the casting direction. The caster comprises a pair of facing endless casting belts serving as mold walls which are moved in the casting direction and define the upper and lower extent of the casting cross section and facing endless articulated mold walls of dam blocks which define the sides of the casting cross section, the mutual spacing between articulated mold walls as well as between the casting belts being larger in the initial (upstream) region of the casting cross section than in the end (downstream) region.

Casters of the above-mentioned type permit the casting of lead, zinc and copper at higher speeds. Prior art techniques are known for accurately compensating for shrinkage occurring in the width of the casting between the moving articulated mold walls as a result of the cast metal cooling off and hardening. Such techniques include placing guide rails associated with the moving dam blocks at a suitable angle. However, with respect to the casting height between the casting belts only an approximate shrinkage compensation has been attempted in the past. Such compensation has been produced by deforming the casting belt by means of convex supporting rollers so that at least in the center region of the casting belt there appears a section of contact with the thinning cast strand. This known solution has the drawback that in the transition region with the walls formed by the dam blocks, which walls serve as the lateral boundary of the cast strand, there is formed a more or less large cavity which may possibly be filled with air. Moreover, due to the deformation by means of the convex supporting rollers, the casting belt is considerably stressed, whereby in the region of the rigid dam blocks which have been used, there is produced a sharp edge which increases wear on the casting belts.

SUMMARY OF THE INVENTION

An object of the present invention is to provide a continuous casting apparatus which is arranged to compensate for shrinkage with the least possible stress on the casting belts, and to permit a rather steady, perhaps even nonlinear adaptation of the casting cross section in the region of the casting belts.

The above and other objects are accomplished according to the present invention in which a continuous casting apparatus is provided for a metal casting which is arranged to compensate for shrinkage of the casting in a cross-sectional plane of the casting normal to the casting direction. The apparatus includes a pair of endless casting belts each spaced from and facing the other to form respective mold walls and arranged for movement in the casting direction. A pair of endless articulated mold walls each spaced from and facing the other, is disposed between the casting belts and arranged to move with the casting belts in the casting direction. The spacing between the articulated mold walls and between the casting belts is greater upstream than downstream relative to the casting direction. Each articulated mold wall includes a plurality of dam blocks. Each dam block includes an inner face disposed at an angle relative to the casting belts and defining a surface of the casting transverse to the casting belts and an outer face disposed at an angle relative to the casting belts and facing a direction opposite to that of the inner face. At least one of the faces of each dam block is adjustable in height between the casting belts. Guide means are provided for adjusting the height of the at least one face of each dam block.

Since the casting apparatus according to the present invention is intended to be used particularly for casters for steel where the mold walls are moved in the casting direction, it must be designed in such a manner that it can handle the greater linear shrinkages in steels (approximately 1.5% compared to 0.57% for copper) and the resulting greater conicity of the casting cross section. The best possible adaptation to the shrinkage process, i.e. to the thinning cast strand, is of considerable significance since only then is it possible to realize in the region of the discharge end of the caster a uniformly strong, thin shell for the cast strand and symmetrical, undisturbed hardening of the cast strand with the resulting steel quality.

The idea on which the present invention is based is that the dam blocks which serve as the lateral boundaries of the casting cross section and form the articulated walls are adjustable in height at least on one of their sides, and guide elements are provided which, by changing the height dimension during movement of the dam blocks in the casting direction, provide the required adaptation to the shrinkage process occurring in the region of the mold walls. The adjustment in the height dimension may be effected, according to the invention, at the inner surface of each dam block which laterally defines the casting cross section and/or at the outer surface facing away from the casting cross section. In other words, the articulated walls are assembled of dam blocks in such a manner that the space between the casting belts, which determines the height dimension of the cast strand, is gradually reduced in the casting direction.

With respect to the oblique positioning of the articulated walls in the casting direction, the casting apparatus may be designed in such a manner that the oblique placement is effected in a plurality of independent sections, particularly with the use of guide rails or control cams which laterally support the articulated walls and are movable with respect to one another.

In a particularly preferred embodiment of the invention, the dam blocks have a height-adjustable inner surface which defines the lateral dimension of the casting cross section.

The adaptation of the height dimension of the inner surface of the dam blocks is realized in one embodiment of the invention by providing dam blocks which each comprise a plurality of components which are movable against one another. In an advantageous embodiment of the present invention, the dam blocks on either side of the casting cross section are composed of two principal bodies which are pivotal against one another about an axis parallel to the casting direction. By enlarging the inclination of the principal bodies with respect to one another the dimension of the inner surface laterally defining the casting cross section can be gradually reduced so that the mutual spacing between the coacting casting belts in the region between the dam blocks changes from, for example, 70 mm in the initial (upstream) region of the casting cross section to 69 mm in the end (downstream) region. In this connection it must be considered that in the initial region of the casting cross section, i.e. when the principal bodies of the dam blocks are not inclined with respect to one another, the cast strand fills the casting cross section; while in the end region, where the principal bodies are inclined with respect to one another, a strand shell is already formed whose corner regions do not rest against the mold walls. But this is no disadvantage since the exposure of the corner regions is compensated by the greater cooling effect at that location so that the cast strand will solidfy uniformly.

In order for the dam blocks composed of the two principal bodies to form a tight inner surface, the two principal bodies have respective cylindrical and mutually supporting surfaces whose mutual longitudinal axis is parallel to the casting direction. The principal bodies are thus pivotal with respect to one another transversely to the casting direction. Their mutual angular position can be changed in a simple manner by means of supporting elements which at least indirectly engage the dam blocks. In order to attain the required tilting force, these supporting elements are of different design as seen in the casting direction. The casting belts which face one another with reference to the casting cross section are able to adapt themselves without any particular additional stress to the angular position of the respectively engaged principal body as this angular position gradually changes in the casting direction.

The two pivotally mutually supported principal bodies include a lower principal body which has an opening to receive and fasten a dam block chain which interconnects the dam blocks and a head body resting thereon. Both the lower principal body and the head body are preferably made of a copper alloy.

In another advantageous embodiment of the present invention, the dam blocks on each side of the casting cross section each comprise two wedge members supported on one another via wedge faces, the wedge members being mutually displaceable by means of control cams disposed in the casting direction. In order to facilitate adaptation to changing casting conditions, at least one of the control cams is designed to be adjustable for changing the dimensions of the space enclosed by the casting belts and the articulated walls in the casting direction.

On the side facing the wedge members, the control cams are advantageously provided with a slide member along which the wedge members can move without much friction. The mutually supported wedge members are components of two dam block chains which are supported on two guide rails extending in the casting direction which constitute the control cams. These guide rails may also be composed of several parts in order to permit the realization of differently configured adaptable sections.

In still another advantageous embodiment of the invention, adaptation to the shrinkage process within the caster is permitted by making the dam blocks elastically deformable at least in the region of one side of the dam blocks, preferably in the region of their outer surface facing away from the casting cross section. In this embodiment of the invention, each dam block preferably has a recess extending longitudinally from its outer surface toward its inner surface to form spreader arms for supporting a tensioned mechanical spring element disposed within the recess. The recess may also be designed as a slit, as long as the dimension of the slit assures sufficient deformability of the dam blocks. The deformation of the dam blocks is caused to change in the casting direction, by means of supporting elements which at least indirectly engage the dam blocks. Preferably the supporting elements are a succession of stationary supporting rollers on which the casting belts are supported. Preferably the supporting rollers extend beyond the casting cross section in the region of the dam blocks.

The elastically deformable, preferably one-piece dam blocks are made, in particular, of a copper alloy which remains sufficiently elastic when the dam blocks pass through the caster. Deformation of the dam blocks may be limited, in particular, by adjustable spacer bolts disposed in the region of the supporting elements.

Instead of the elastically deformable, one-piece dam blocks, it is also possible to use, in particular, two-part dam blocks produced by means of a connecting axle and a spring element. Such dam block designs must additionally be provided, in particular, with a device which prevents the mutually movable parts from flipping apart when not under load. A particularly simple design is a holding bolt which connects the two movable components together, transversely to the connecting axis, so that they are movable within a set range.

DESCRIPTION OF THE PREFERRED EMBODIMENTS

Referring to FIG. 2, a casting arrangement according to the invention includes as its essential components four mold walls which are movable in the casting direction and which enclose a rectangular casting cross section 1. The four mold walls are formed by upper and lower endless casting belts 2 and left and right endless articulated walls 3, the latter constituting the lateral boundaries of the casting cross section.

Figure 1:
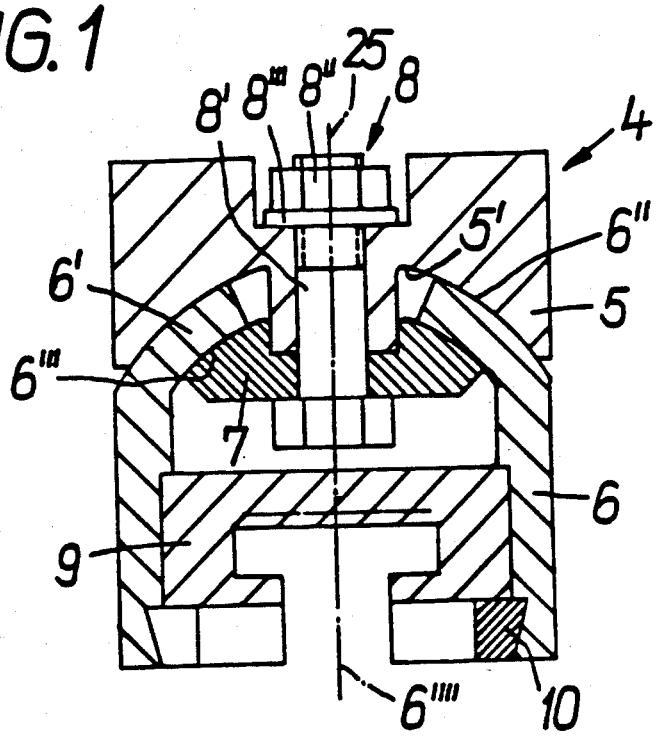
FIG. 1 is a vertical cross sectional view of a dam block employed in one embodiment of the casting apparatus according to the invention.

The articulated walls 3 are composed of individual dam blocks 4 shown in FIG. 1. Each dam block 4 includes an upper head section 5 and a base member 6 supporting head section 5, both being made of a copper alloy.

In the region of head section 5, base member 6 is equipped with a cylindrical section 6' which has cylindrical faces 6'' and 6'''. Head section 5 has a cylindrical face 5' corresponding to cylindrical face 6'' and is pivotally supported directly at cylindrical face 6'' and via a bearing plate 7 which bears against cylindrical surface 6'''. Members 5 and 7 are releasably connected together via a screw connection 8 including a screw 8', nut 8'' and locking ring 8'''.

Below cylindrical section 6', base member 6 is equipped with a guide member 9 which is held by means of a spring ring 10. Guide member 9 accommodates a narrow steel band (not shown) with which individual dam blocks 4 are combined to form an endless articulated wall. Outside casting cross section 1, the mold walls are equipped with deflection wheels 26 having horizontally disposed axles 26' (see FIG. 5*c*).

Figure 2A:
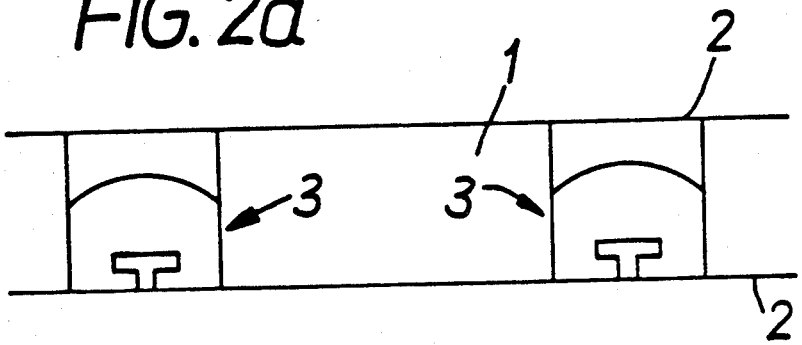
FIG. 2*a* is a schematic representation of an upstream end view of a casting apparatus according to the invention.

In the initial (upstream) region of casting cross section 1, the principal bodies 6 and 5 of dam blocks 4 take on the starting position shown in FIGS. 1 and 2*a* in which the vertical axis 5' of head section 5 coincides with the vertical axis 6'''' of base element 6.

Figure 2B:
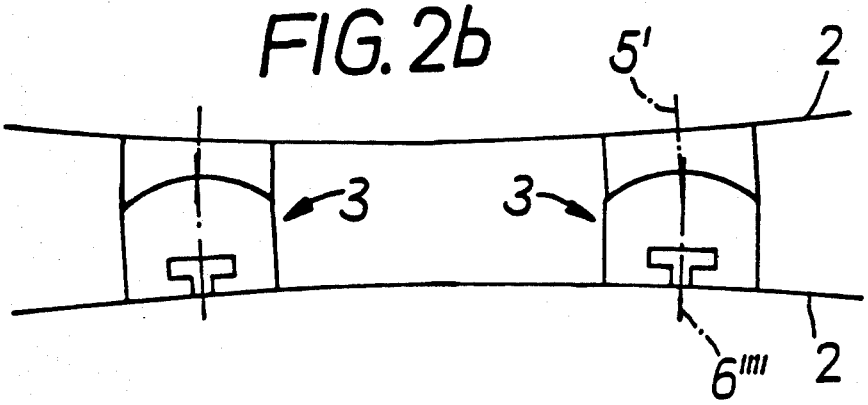
FIG. 2*b* is a schematic representation of a downstream end view of a casting apparatus according to the invention.
Figure 2C:
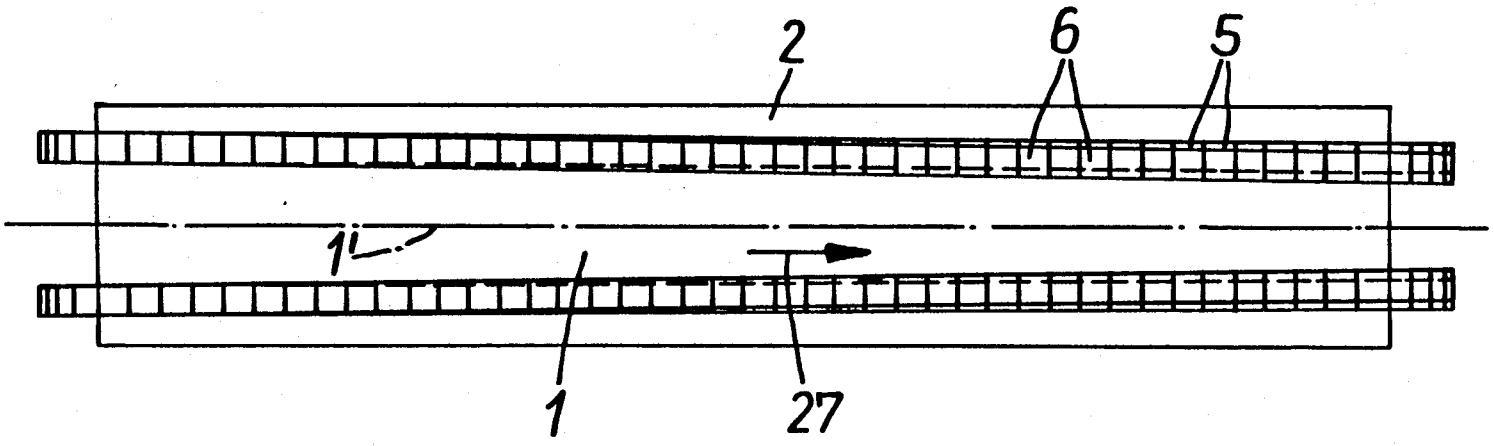
FIG. 2*c* is a schematic top plan view of the casting apparatus according to FIGS. 2*a, b* showing two endless articulated walls composed of individual dam blocks and the lower endless casting belt, the upper endless casting belt being omitted for the sake of clearness.

In an example of this embodiment, the mutual spacing between the horizontally extending casting belts 2 in the upstream region is 70 mm. During passage through the caster in the casting direction (into the plane of the drawings), dam blocks 4 and also casting belts 2 are gradually displaced or deformed, respectively, with the aid of differently designed supporting rollers (such as shown in FIG. 5*c*) in such a manner that in the end region (FIG. 2*b*) of the casting cross section casting belts 2 have a mutual spacing of 69 mm. The pivotal movement of the principal bodies 5 and 6 with respect to one another has the result that the vertical axes 25 and 6'''' are at an angle to one another as shown in FIG. 2*b* and as top plane view in FIG. 2*c*.

Figure 3A:
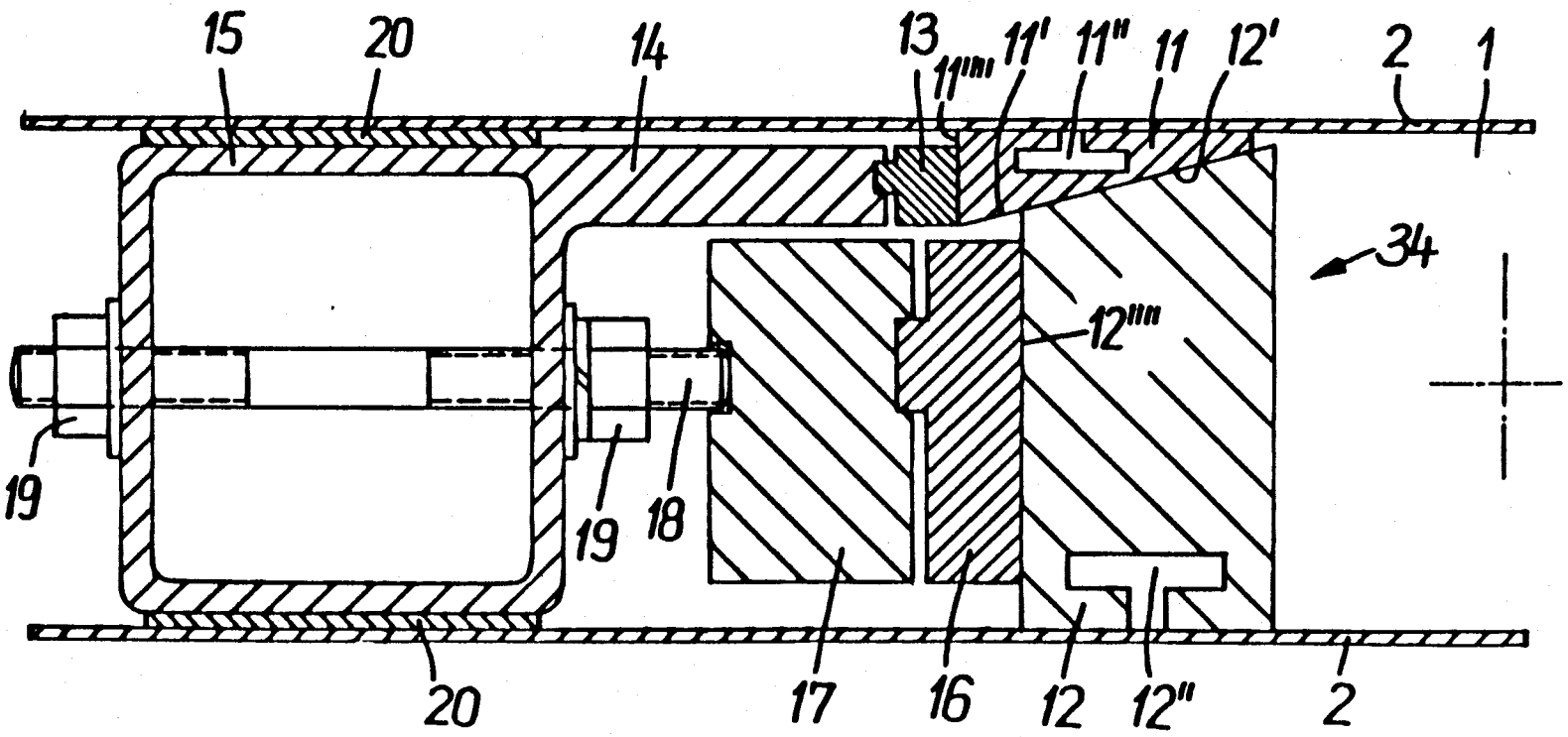
FIG. 3*a* is a partial vertical cross sectional end view of components of another embodiment of a casting apparatus according to the invention.

In the embodiment shown in FIGS. 3*a, b*, a dam block 34 is shown as comprising an upper wedge member 11 and a lower wedge member 12 supported on one another via respective wedge faces 11' and 12' that are inclined with respect to the horizontal. A plurality of dam blocks 34 of the type shown in FIGS. 3*a*,b are combined into endless articulated walls via respective T-shaped recess 11'' and 12'', each accommodating a steel band (not shown).

Figure 3B:
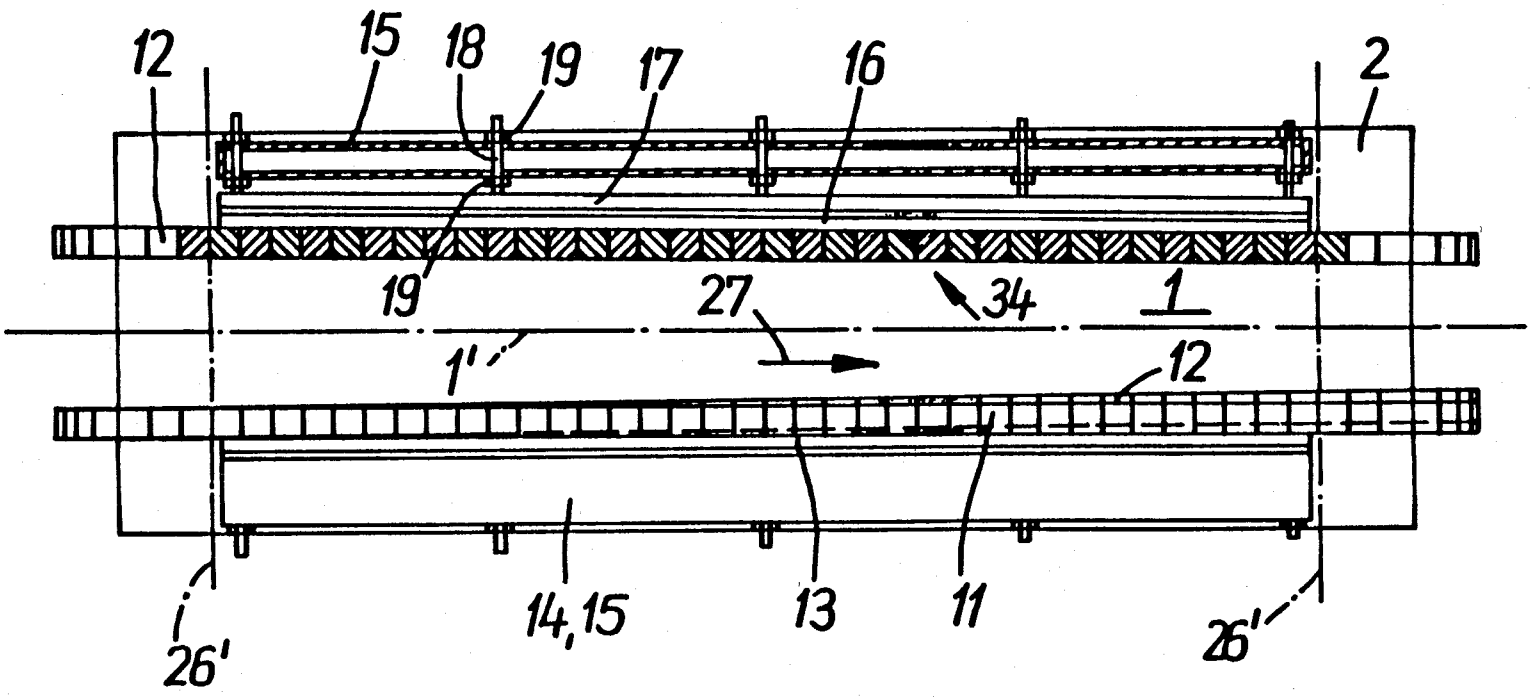
FIG. 3*b* is a schematic top plan view (lower half) and a horizontal sectional view (upper half) of a casting apparatus according to FIG. 3*a*, the sectional view lying in the range of a hollow support for the guide elements bearing the lower wedge members of the dam blocks which form one of the two endless articulated walls of the casting apparatus.

By means of such steel bands, dam blocks 34 as well as casting belts 2 in the region of the casting cross section 1 are moved in the casting direction as indicated by arrow 27 in FIG. 3*b*. The upper steel band is returned in an arc above the caster, whereas the lower steel band is returned in an arc below the caster.

On a side 11'''' facing away from casting cross section 1, upper wedge member 11 is supported, through the intermediary of a slide strip 13, at a guide rail 14 which itself is a component of a stationary hollow support 15.

Lower wedge member 12 is likewise laterally held at a side 12'''' against a guide rail 17 through the intermediary of a slide strip 16. Guide rail 17 is fastened to a setting bolt 18 which itself can be set, via setting nuts 19 and with respect to the hollow support 15, transversely to the longitudinal extent of casting cross section 1.

Displacement of setting bolt 18 to the right results not only in a shift to the right of wedge member 12 but simultaneously also in a reduction of the space between facing casting belts 2.

Casting cross section 1 may thus be adapted to the shrinkage process occurring in the caster without any unfavorable deformation of planar casting belts 2 by suitably mutually setting guide rails 14 and 17 in the casting direction via a plurality of setting bolts 18 spaced in the casting direction, indicated by arrow 27 (see FIG. 3*b*, upper half).

All parts provided for the displacement of wedge members 11 and 12 may be desposed between facing casting belts 2. The upper and under sides of hollow support 15 are preferably covered with a coating 20 of sealing material in order to seal the arrangement against water.

Figure 4A:
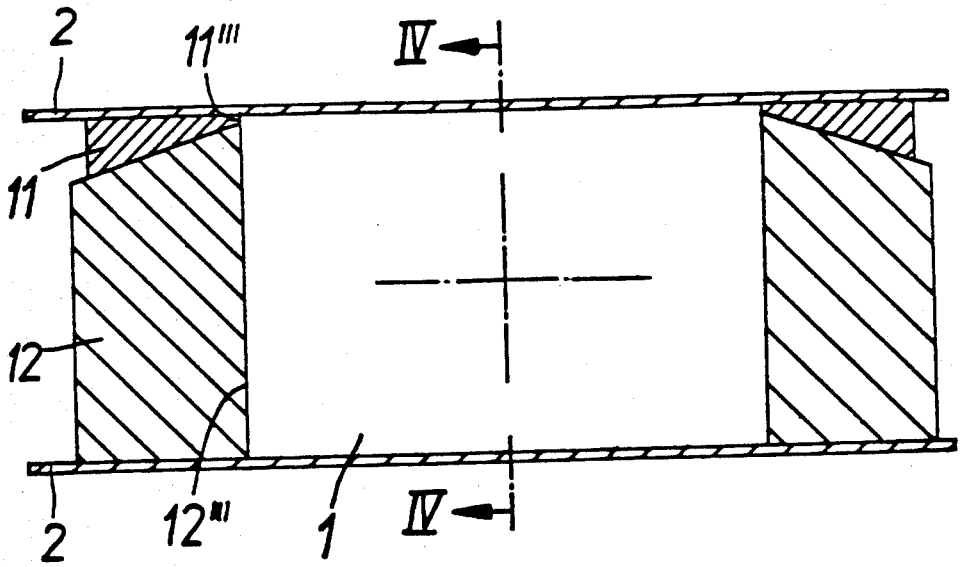
FIG. 4*a* is a partial vertical cross sectional end view of components in the upstream region of a casting apparatus according to the embodiment illustrated in FIGS. 3*a, b*.
Figure 4B:
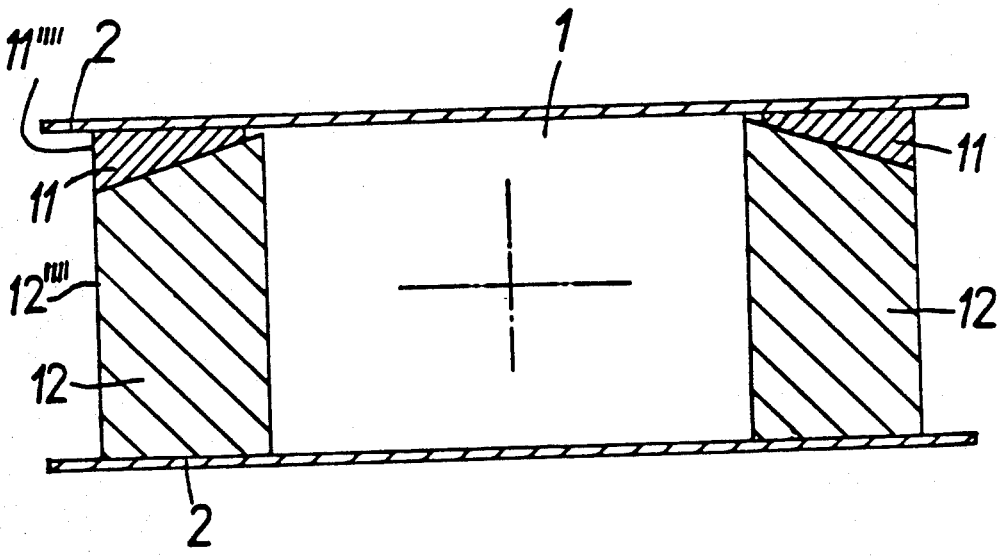
FIG. 4*b* is a partial vertical cross sectional end view of components in the downstream region of a casting apparatus according to the embodiment illustrated in FIGS. 3*a, b*.
Figure 4C:
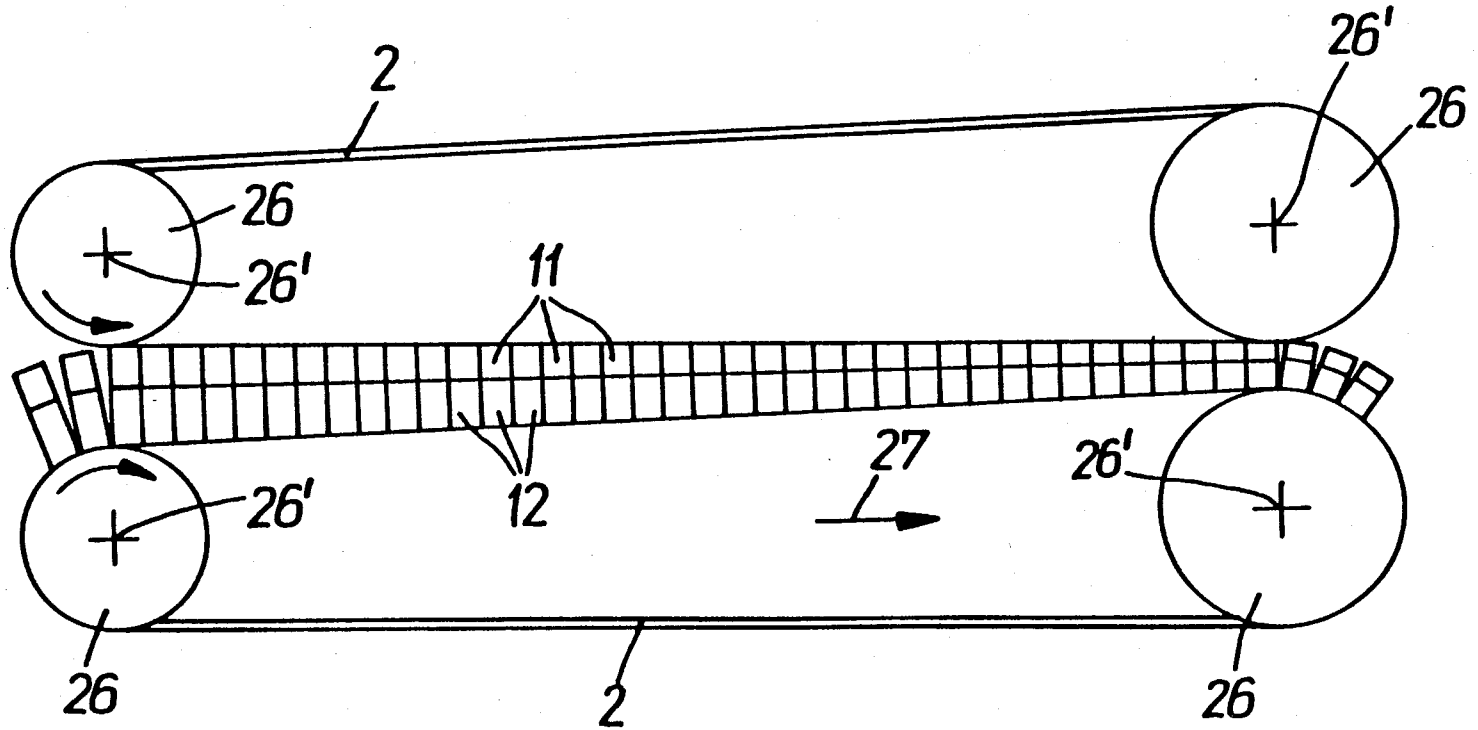
FIG. 4*c* is, at a smaller scale, a vertical sectional view through a casting apparatus according to line IV—IV in FIG. 4*a*.

The effect of the coaction of the upper and lower wedge pieces 11 and 12, respectively, is shown in FIGS. 4*a* through 4*c*. In the initial (upstream) region (FIG. 4*a*) of casting cross section 1, mutually displaceable wedge members 11 and 12 are arranged in such a manner that partial faces 11''' and 12''' form a continuous inner face as shown in FIG. 4*a*.

In an example of a casting apparatus according to the embodiment of FIGS. 3*a, b* and 4*a, b, c*, the casting cross section in the upstream region is 70×180 mm. During passage through the caster, wedge members 11 and 12 (as can be seen from FIG. 4*c*) are gradually displaced under the influence of guide rails 14 and 17 so that their outer faces 11'''' and 12'''' change from one position to the other without a step (FIG. 4*b*). The result is that in its end (downstream) region the casting cross section has a height of 69 mm and a width of 177 mm in this particular example.

With suitable configuration of wedge members 11 and 12 and suitable setting of guide rails 14 and 17 care can thus be taken that casting cross section 1 adapts itself automatically to the shrinkage process occurring in the caster when mold walls 2 and 3 move in the casting direction (see arrow 27).

The particular advantage of the embodiment of FIGS. 3 and 4 is that in the initial (upstream) region (FIG. 4*a*) of the casting cross section, i.e. in the region in which the cast strand has practically no strand shell yet formed, wedge members 11 and 12 which form dam blocks 34 form a continuous, closed lateral boundary wall. In contradistinction thereto, such a continuous boundary wall need not be and is not present in the end (downstream) region of the casting cross section (FIG.

4*b*) because there the cast strand already has a sufficiently strong shell. Moreover, the corners of the cast strand in the downstream region do not, in any case, contact the mutually angled, moving mold walls due to the shrinkage process that takes place as the cast strand solidifies.

Figure 5A:
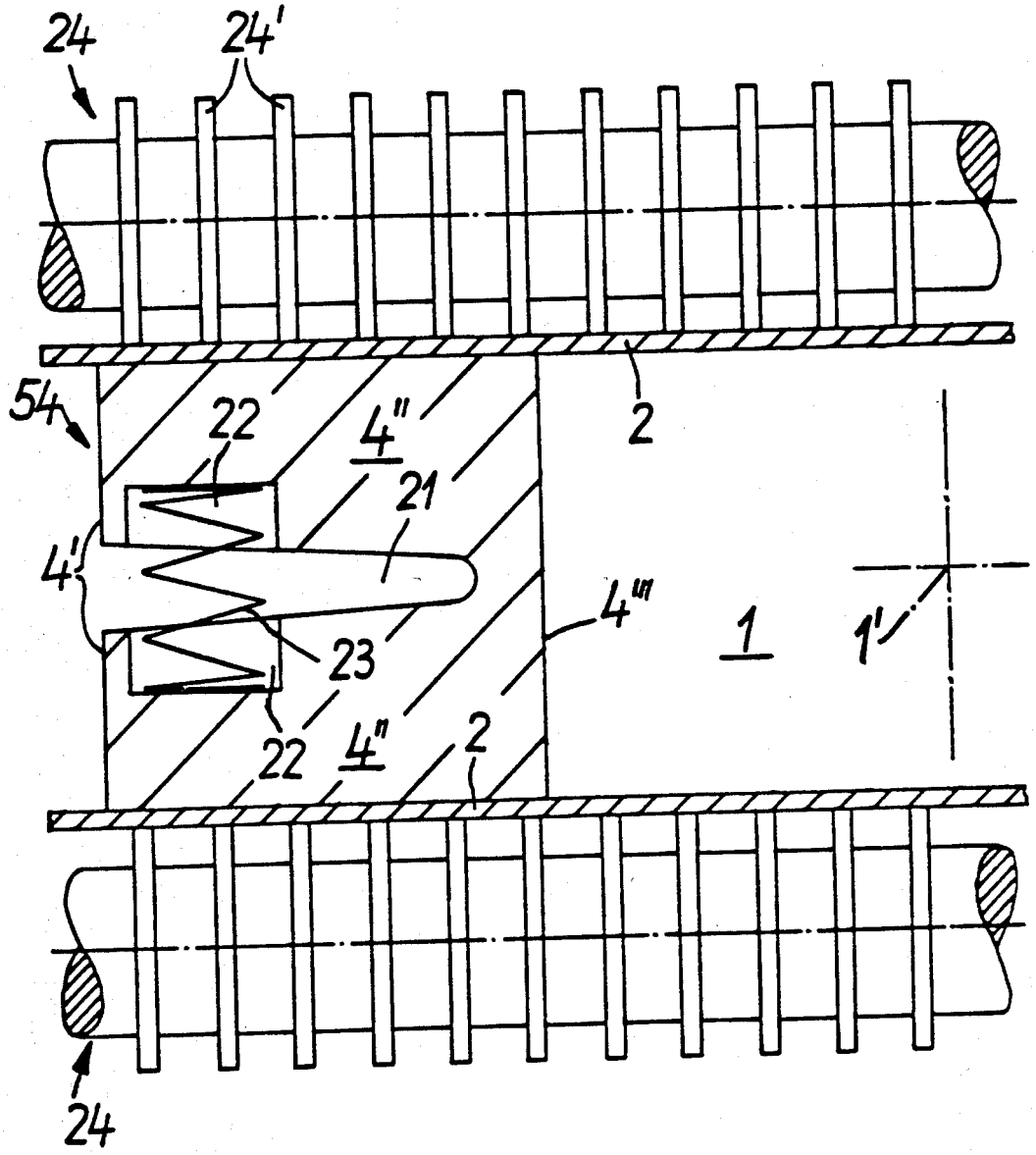
FIG. 5*a* is a partial vertical cross sectional end view in partial elevation showing components in the upstream region of casting apparatus according to a further embodiment of the invention.
Figure 5B:
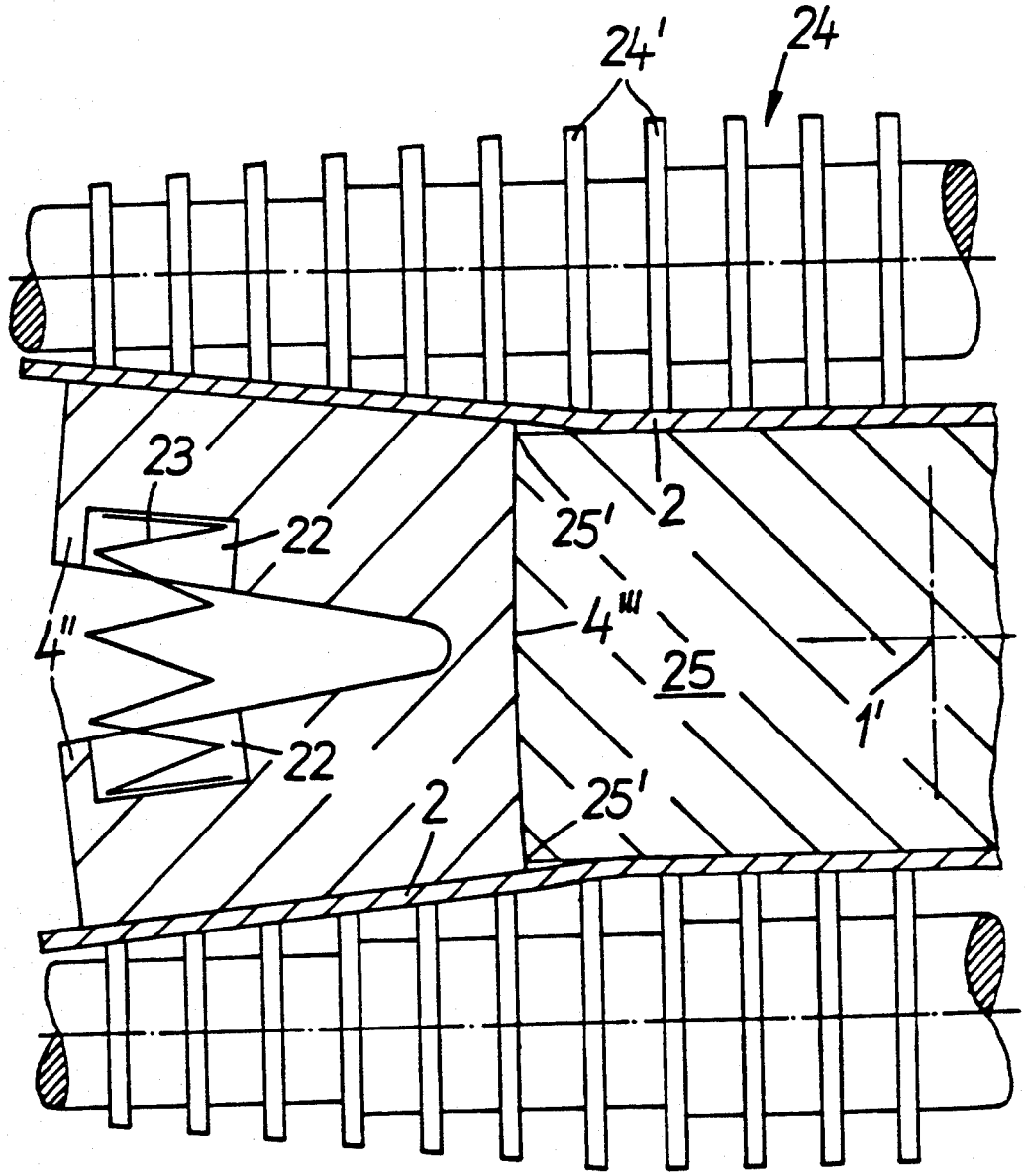
FIG. 5*b* is a partial vertical cross sectional end view in partial elevation showing components in the downstream region of the casting apparatus according to the embodiment of FIG. 5*a*.
Figure 5C:
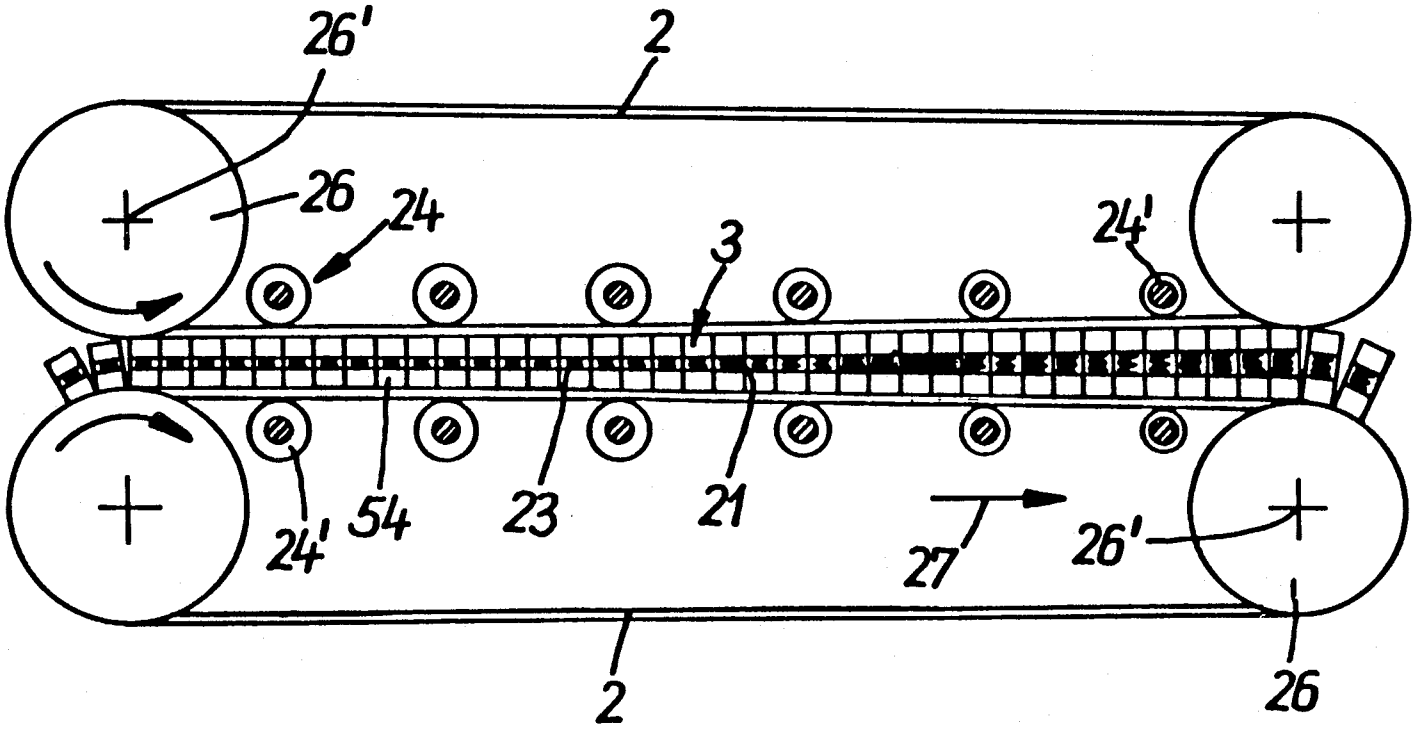
FIG. 5*c* is, at a smaller scale, a side view of the embodiment according to FIGS. 5*a, b* in the direction of the outer faces of the dam blocks forming an endless articulated wall and cooperating with an upper and a lower endless casting belt.

According to a further embodiment of the invention, casting cross section 1 can be adapted to the shrinkage process by the use of articulated walls 3 composed of elastically deformable dam blocks 54 as shown in FIGS. 5*a* through 5*c*. In the region of their outer face 4' facing away from casting cross section 1, these dam blocks are provided with a recess 21, starting at the outer face 4' facing away from the casting cross section 1 and extending longitudinally inward toward inner face 4'''. This recess 21 divides the dam block into two interconnected spreader arms 4''. In other words, the longitudinal extent of recess 21 is shorter, seen transversely to the casting direction, than the width of the respective dam block.

On the side facing away from casting cross section 1 (i.e. in the vicinity of outer face 4'), spreader arms 4'' are each provided with pairs of facing bearing bores 22 which support a tensioned helical spring 23. Under the influence of the at least one helical spring 23, dam block 54 can be deformed, if necessary, to such an extent that its outer face 4' has a different height dimension than its inner face 4''' which forms the lateral boundary wall for casting cross section 1.

The deformation of dam blocks 54 moving in the casting direction (see arrow 27) is effected by means of supporting elements which are comprised, in particular, of stationarily arranged supporting rollers 24 with juxtaposed supporting sections 24'. In the region of casting cross section 1 as well as in the region of dam blocks 54, these supporting elements serve as supports for casting belts 2. Thus, in the case of the illustrated embodiment, supporting sections 24' engage dam blocks 54 indirectly, i.e. via casting belts 2.

In order to adapt them to the already mentioned shrinkage process, supporting rollers 24 are designed differently in their succession in the casting direction (see FIG. 5*c*). As can be seen in FIG. 5*a*, supporting rollers 24 which face one another with respect to casting cross section 1 press dam blocks 54 together in the initial (upstream) region so that a rectangular casting cross section results, for example with a height dimension of 70 mm. Thus, supporting rollers 24 absorb the spring force emanating from the at least one helical spring 23.

Supporting rollers 24 following in the casting direction are modified in such a manner that, with simultaneous elastic deformation of dam blocks 54, casting cross section 1 is gradually changed so as to approximately adapt it to the shrinkage process (see FIG. 5*c*).

In the end (downstream) region of the casting cross section shown in FIG. 5*b*, the diameters of supporting sections 24' are graduated transversely to the casting direction in such a manner that spreader arms 4'' of dam blocks 54 are spread away from one another and casting belts 2, in continuation of the path resulting from the spreading, slightly converge toward the longitudinal axis 1' of casting cross section 1. The graduation of the supporting sections 24' is, in this example, preferably selected in such a manner that the height dimension of casting cross section 1 in the downstream region is only 69 mm in the vicinity of the inner face 4''' of dam blocks 54.

FIG. 5*b* shows that the corners 25' of the cast strand 25 do not contact the mutually angled surfaces of casting belts 2 and dam block face 4'''. Moreover, for reasons of clarity, the angle of the casting belt is shown grossly exaggerated.

In the above-described embodiment, elastically deformable dam block 54 is made of a copper alloy. In a modification of this embodiment, spreader arms 4'' may be pivotally in communication with one another via a connecting axis. In this case, dam block 54 is thus made of two parts.

The dam blocks are preferably dimensioned and designed such that during passage through the caster they are heated at most to about 500° C. This is required to maintain sufficient elasticity particularly for the embodiment shown in FIG. 5.

If supporting sections 24' at supporting roller 24 (see FIG. 5*b*) exhibit noticeable differences in diameter, they are advisably mounted to be rotatable at the supporting roller so that they are able to rotate at different rates if required. However, particularly in the end (downstream) region of casting cross section 1, supporting rollers 24 may also be designed such that they simultaneously include both movable and stationary supporting sections 24'. To exclude, if required, additional stresses on casting belts 2, supporting sections 24' cooperating with dam blocks 54 may be rotatably mounted at supporting roller 24 while supporting sections 24' in the region between dam blocks 54, i.e. in the region of the casting strand, are fixed components of supporting roller 24.

FIG. 5*c* shows that the recesses 21 of the dam blocks 54 at their outer faces 4' become more and more greater while moving in the direction of arrow 27.

The endless mold walls, i.e. the casting belts 2 such as the articulated walls 3 composed of the dam blocks 54, are equipped with deflection wheels 26 having horizontally desposed axles 26'. The wheels also serve to lead back the mold walls to the extrance of the casting cross section (i.e. in FIG. 5*c* to the left deflection wheels).

It will be understood that the above description of the present invention is susceptible to various modifications, changes and adaptations, and the same are intended to be comprehended within the meaning and range of equivalents of the appended claims.

What is claimed is:

1. A continuous casting apparatus for a metal casting arranged to compensate for shrinkage of the casting in a cross sectional plane of the casting normal to the casting direction, said apparatus comprising:

a pair of endless casting belts each spaced from and facing the other to form respective mold walls and arranged for movement in the casting direction;

a pair of endless articulated mold walls each spaced from and facing the other, disposed between said casting belts and arranged to move with said casting belts in the casting direction, the spacing between said articulated mold walls and between said casting belts being greater upstream than downstream relative to the casting direction, wherein each said articulated mold wall includes a plurality of dam blocks, each said dam block has an inner face disposed at an angle relative to said casting belts and defining a surface of the casting transverse to said casting belts and an outer face disposed at an angle relative to said casting belts and facing a direction opposite to that of said inner face, and at least one of the faces of each said dam block is adjustable in height between said casting belts; and guide means for adjusting the height of said at least one face of each said dam block.

2. Apparatus as defined in claim 1 wherein the height of the inner face of each said dam block is adjustable.

3. Apparatus as defined in claim 1, wherein each said dam block includes a plurality of mutually movable components.

4. Apparatus as defined in claim 1, wherein each said dam block includes two principal bodies which are pivotal with respect to one another about an axis parallel to the casting direction.

5. Apparatus as defined in claim 4, wherein the two principal bodies of each said dam block have respective and mutually supporting cylindrical faces which have a mutual longitudinal axis that is parallel to the casting direction.

6. Apparatus as defined in claim 4, wherein said guide means includes supporting elements which engage said dam blocks and pivot said principal bodies so that the mutual angular position of the principal bodies of the respective dam blocks is varied in the casting direction.

7. Apparatus as defined in claim 6, wherein said supporting elements indirectly engage said dam blocks.

8. Apparatus as defined in claim 6, wherein said supporting elements include a succession of stationary supporting rollers disposed in the casting direction and in supporting engagement with said casting belts in the region of said dam blocks.

9. Apparatus as defined in claim 8, wherein said rollers extend beyond the space enclosed between said articulated belts.

10. Apparatus as defined in claim 1, wherein the dam blocks of each said articulated wall each comprise two wedge members having respective and mutually supporting wedge faces and said guide means include control cams disposed in the casting direction for displacing one wedge member of each said block with respect to the other wedge member of a respective one of said dam blocks in a direction transverse to the casting direction.

11. Apparatus as defined in claim 10, wherein said casting belts and said articulated walls enclose a casting space and at least one of said control cams is adjustable for changing the dimensions of the casting space.

12. Apparatus as defined in claim 10, wherein said control cams each include a slide element having a sliding engagement with a respective one of said wedge members.

13. Apparatus as defined in claim 10, wherein the dam blocks of a respective one of said articulated walls are connected together to form respective dam block chains and said control cams comprise two sets of two guide rails, each set extending in the casting direction for supporting a respective one of said dam block chains.

14. Apparatus as defined in claim 1, wherein each said dam block is, at least in the region of its outer face, elastically deformable.

15. Apparatus as defined in claim 14, and further including spring elements, wherein each said dam block has a recess starting at its outer face and extending toward its inner face, one of said spring elements is supported in a respective one of said recesses, and said guide means includes supporting elements for engaging said dam blocks and for producing a deformation of said dam blocks which changes in the casting direction.

16. Apparatus as defined in claim 15, wherein said supporting elements engage said dam blocks indirectly.

17. Apparatus as defined in claim 15, wherein each said dam block includes two spreader arms formed by a respective one of the recesses and each said spring is a tensioned mechanical spring supported by the spreader arms of a respective one of said dam blocks.

18. Apparatus as defined in claim 15, wherein said supporting elements include a succession of stationary supporting rollers disposed in the casting direction and in supporting engagement with said casting belts in the region of said dam blocks.

19. Apparatus as defined in claim 13, wherein said rollers extend beyond the space enclosed between said articulated belts.

* * * * *